US010113397B2

(12) United States Patent
Gregory et al.

(10) Patent No.: US 10,113,397 B2
(45) Date of Patent: Oct. 30, 2018

(54) PROPULSION GENERATOR AND METHOD

(71) Applicant: Coil Solutions, Inc., Calgary (CA)

(72) Inventors: Marvin A. Gregory, Spring, TX (US); Robert J. Kletzel, Medicine Hat (CA)

(73) Assignee: Coil Solutions, Inc., Calgary, Alberta (CA)

( * ) Notice: Subject to any disclaimer, the term of this patent is extended or adjusted under 35 U.S.C. 154(b) by 0 days.

(21) Appl. No.: 15/603,655

(22) Filed: May 24, 2017

(65) Prior Publication Data

US 2017/0254182 A1 Sep. 7, 2017

Related U.S. Application Data

(63) Continuation of application No. 14/870,431, filed on Sep. 30, 2015, now Pat. No. 9,689,234, which is a continuation of application No. 13/335,898, filed on Dec. 22, 2011, now Pat. No. 9,175,535.

(60) Provisional application No. 61/540,821, filed on Sep. 29, 2011.

(51) Int. Cl.

| | |
|---|---|
| ***E21B 31/00*** | (2006.01) |
| ***E21B 41/00*** | (2006.01) |
| ***E21B 4/02*** | (2006.01) |
| ***E21B 4/18*** | (2006.01) |
| ***E21B 7/24*** | (2006.01) |
| ***E21B 17/20*** | (2006.01) |
| *E21B 23/00* | (2006.01) |

(Continued)

(52) U.S. Cl.

CPC ..... *E21B 41/00* (2013.01); *E21B 4/02* (2013.01); *E21B 4/18* (2013.01); *E21B 7/24* (2013.01); *E21B 17/20* (2013.01); *E21B 31/005* (2013.01); *E21B 19/22* (2013.01); *E21B 23/14* (2013.01); *E21B 2023/008* (2013.01); *Y10T 29/494* (2015.01)

(58) Field of Classification Search

CPC ..... E21B 7/24; E21B 31/005

USPC ..... 166/177.1, 177.6, 301; 175/55–57, 92, 175/317, 106, 107, 100; 384/255, 447; 366/600; 181/119, 113, 121; 73/66, 570

See application file for complete search history.

(56) References Cited

U.S. PATENT DOCUMENTS 2,743,083 A * 4/1956 Zublin ..... E21B 7/24 173/73

2,871,943 A * 2/1959 Bodine, Jr. ..... B01J 19/10 166/177.1

(Continued)

OTHER PUBLICATIONS

Canadian Office Action dated Feb. 27, 2017, issued in Application No. 2,774,698.

*Primary Examiner* — William D Hutton, Jr.
*Assistant Examiner* — Steven A MacDonald
(74) *Attorney, Agent, or Firm* — Ramey & Schwaller, LLP

(57) ABSTRACT

A propulsion generator which employs one or more unbalanced rotors, such as fly wheels or other unbalance rotating members, which can be connected at a lower portion of a downhole coiled tubing string or other downhole tubular string for inducing propulsion of the coiled tubing. The unbalanced rotors may be oriented at different positions with respect to each other. The instantaneous fluid flow through the propulsion generator is substantially equivalent to the average fluid flow rate through the tool to provide relatively consistent fluid flow to downhole motors below the propulsion generator for operating the drill bit and/or cutters.

13 Claims, 18 Drawing Sheets

(51) Int. Cl.
*E21B 19/22* (2006.01)
*E21B 23/14* (2006.01)

(56) References Cited

U.S. PATENT DOCUMENTS 2,970,660 A * 2/1961 Bodine, Jr. ..... E21B 7/24 173/49
3,191,911 A * 6/1965 Bodine, Jr. ..... B06B 1/186 366/124
3,193,027 A * 7/1965 Bodine ..... E02D 7/18 175/19
3,295,837 A * 1/1967 Bodine, Jr. ..... B06B 1/18 173/49
4,300,843 A * 11/1981 Halilovic ..... B06B 1/186 366/125
4,667,742 A * 5/1987 Bodine ..... E21B 7/24 166/301
4,709,362 A * 11/1987 Cole ..... G01V 1/153 181/121
4,742,721 A * 5/1988 Pouillon ..... B06B 1/16 209/367
7,900,716 B2 3/2011 Ibrahim
2007/0133913 A1* 6/2007 Heck ..... F16C 23/10 384/447
2009/0173542 A1* 7/2009 Ibrahim ..... E21B 7/24 175/55
2013/0195390 A1* 8/2013 Haecker ..... F04B 9/04 384/447

* cited by examiner

PROPULSION GENERATOR AND METHOD

CROSS-REFERENCE TO RELATED APPLICATIONS

This application is a continuation of U.S. application Ser. No. 14/870,431, filed Sep. 30, 2015, which is a continuation of U.S. application Ser. No. 13/335,898, filed Dec. 22, 2011, now U.S. Pat. No. 9,175,535, issued Nov. 3, 2015, which claims the benefit of U.S. Appl. No. 61/540,821, filed Sep. 29, 2011, all incorporated by reference herein.

BACKGROUND OF THE INVENTION

Field of the Invention

The present invention relates generally to methods and apparatus for operating well bore tubing and, more particularly, to advancing the bottom assembly of a drilling string and/or freeing the drilling string including but not limited to a coiled tubing string in a borehole.

Description of the Prior Related Art

It is well known to those of skill in the art that there are limits to the ability of a surface rig to push a tubular string into a bore hole. After a certain depth is reached, the flexibility of the tubular string does not permit the transmission of force through the length of the string to move the bottom hole assembly. An analogy often made is that of attempting to push a string through a long or sticky tube.

The problem occurs in the drilling of oil and gas wells due to the length of the tubular strings and the drag and potential sticking of the drill string against the well bore wall. This results in increased resistance to movement of the pipe.

This effect is often more evident in a coiled tubing applications. Coiled tubing is typically even more flexible than drill pipes. Coiled tubing strings cannot be rotated in the well bore like drill strings. Coiled tubing also to some extent retains the spiral effect of the diameter of the reel on which the coiled tubing is stored. Therefore, coil tubing may have additional points of drag and sticking of the coiled tubing in the well bore as compared with standard drilling pipe even though the effect is also present with standard drilling pipe.

In wells with high angles and/or horizontal sections, this problem becomes greatly exaggerated, often essentially prohibiting advancement of the drill string.

Many attempts and methods have been employed in the past by those of skill in the art to solve this problem. Prior art attempts to solve problems have included downhole tractors, jars, centralizers, and even wheels and skids. Other attempts utilize pulsation inducing devices, which lengthens the pipe momentarily by a small amount by restricting flow through the drill pipe. However, this technique results in increased fatigue of the drill string. As well, the on and off fluid pulses may not operate downhole motors effectively.

In some cases, the pipe string becomes stuck in the well bore so the string can neither be moved up or down. Perhaps even more devices and methods have been provided to simply loosen and retrieve the stuck string rather than attempting to go deeper in the well. Accordingly, these devices are not designed for advancing the drill string further into the well but rather attempt to retrieve the stuck drill pipe or at least a portion thereof.

The following patents discuss various attempts related to the above discussed problems.

U.S. Pat. No. 3,152,642, issued Oct. 13, 1964, to A. G. Bodine discloses a method of loosening an elastic column (drill string), which is stuck in a well at a distance down from the upper end and which is acoustically free there above that includes applying a torsional bias to the column, acoustically coupling the vibratory output member of a freely operating torsional elastic wave generator to the acoustically free portion of the column above the stuck point and in a manner to apply an alternating torque to the column, and operating the generator at a torsional resonant frequency of the column, and at a power output level developing a cyclic force at the stuck point which exceeds and opposes the force holding the column at the stuck point.

U.S. Pat. No. 3,155,163, issued Nov. 3, 1964, to A. G. Bodine discloses an apparatus for loosening a fish (drill string) at a point below its upper end in a bore hole, includes a grappling tool adapted to rigidly engage the upper end of the fish, a drill collar coupled to the grappling tool, an acoustic vibration located adjacent the upper end of the drill collar comprising a mass element rotatable on and linearly reciprocal along the vertical axis of the drill collar, a non-rotatable member adapted for corresponding reciprocation along the axis, cam means between the mass element and the non-rotatable member for converting rotation of said mass element into axial vibration of the mass element the non-rotatable members, the non-rotatable reciprocal member being coupled to the drill collar for transmission of reciprocating force to the upper end thereof to set up in the collar and fish an acoustic standing wave, an inertia collar adapted to be lowered into the bore hole on a rotatable drill pipe string, suspended from a rotary table at the ground surface, and a torque transmitting spring connecting said inertial collar and the rotatable mass element of the wave generator, the spring being yieldable in a vertical direction too isolate the inertia collar from vibration transmitted upwards from the wave generator.

U.S. Pat. No. 3,500,908, issued Mar. 17, 1970, to D. S. Barler discloses a device for freeing a tubular member stuck within an oil well comprising upper and lower frames mounted on the surface, horizontal plates, a plurality of cylindrical shells, a plurality of pistons mounted in the shells, a plurality of helical springs, means for adjustably supporting the frame at a desired elevation above the well, a pair of heavy eccentrically loaded, power driven bodies that are transversely spaced a fixed distance in a horizontal plane and rotate in opposite directions, with the eccentric loading, and rigid frame members to support the power driven bodies.

U.S. Pat. No. 3,168,140, to A. G. Bodine, issued Feb. 2, 1965, discloses a method of moving a column system embodying a portion held fast in the earth and a portion extending therefrom which is acoustically free and in a condition to sustain a vibration wave pattern that comprises acoustically coupling a fluid-drive vibrator to the acoustically free portion of the column system at a point spaced from and the held portion, and fluid driving the vibration at a frequency which produces resonance of the column system and which establishes a vibration patter with cyclic impulse force in the column system with the region of the held portion, where in the resonant frequency and the vibration patter are established independently of minor irregularities in fluid drive effort by reason of inherent fluid drive flexibility.

U.S. Pat. No. 4,429,743, to Bodine, issued Feb. 7, 1984, discloses a well servicing system in which sonic energy is transmitted down a pipe string to a down hole work area a substantial distance below the surface. The sonic energy is generated by an orbiting mass oscillator and coupled therefrom to a central stem to which the piston of a cylinder-piston assembly is connected. The cylinder is suspended from a suitable suspension means such as a derrick, with the pipe string being suspended from the cylinder in an in-line relationship therewith. The fluid in the cylinder affords compliant loading for the piston while the fluid provides sufficiently high pressure to handle the load of the pipe string and any pulling force thereon. The sonic energy is coupled to the pipe string in a longitudinal vibration mode which tends to maintain this energy along the string.

U.S. Pat. No. 4,667,742, to Bodine, issued May 26, 1987, discloses a method wherein the location of a section of drill pipe which has become stuck in a well some distance from the surface is first determined. The drill string above this location is unfastened from the drill string and removed from the well. A mechanical oscillator is connected to the bottom of the re-installed drill string through a sonic isolator section of drill pipe designed to minimize transfer of sonic energy to the sections of drill string above the oscillator. The oscillator is connected to the down hole stuck drill pipe section for transferring sonic energy thereto. A mud turbine is connected to the oscillator, this turbine being rotatably driven by a mud stream fed from the surface. The turbine rotates the oscillator to generate sonic energy typically in a torsional or quadrature mode of oscillation, this sonic energy being transferred to the stuck section of drill pipe to affect its freeing from the walls of the well.

The above discussed prior art does not address solutions provided by the present invention, which teaches a system that is useful for both advancing the bottom hole assembly further into the well and/or for loosening the pipe to prevent or to free the pipe from becoming stuck in the well bore. The prior art also does not show a tool which has the ability to be reversed causing the drill string to be moved back up the hole.

Consequently, those skilled in the art will appreciate the present invention that addresses the above described and other problems.

SUMMARY OF THE INVENTION

One possible object of the present invention is an improved tool to impart propulsion in a bottom hole assembly.

Another possible object of the present invention is to reduce sticking of tubing including coiled tubing.

Another possible object of the present invention is to apply a sonic vibration into the drilling motor and bit (and bottom hole assembly) resulting in a true sonic and/or vibration drill application.

Accordingly, the present invention may comprises a downhole tool, which in one possible embodiment may comprise an outer tubular housing and a fluid flow path through the housing. In this embodiment, at least one fly wheel may comprise gears or teeth mounted on the fly wheel positioned to encounter fluid flow through the flow path whereby the fly wheel is rotated. The fly wheel could be mounted to provide a center of mass for the fly wheel that is at an offset from the center of rotation, which results in vibrations being created during rotation. The fly wheel may sized and rotated at a speed to produce a gyroscopic effect. In one possible embodiment, a timing wheel may be utilized comprising teeth which engage the flowpath. This engagement could be utilized to delay, control, average, or other affect the flow of the exiting drilling fluid.

In another possible embodiment, a propulsion generator for use in a downhole tool is provided to urge movement of a string of pipe within a well bore, which may comprise elements such as, for example only, an outer tubular housing mountable to the bottom end portion of the string of pipe. The outer tubular defines a fluid flow path through the outer tubular housing to permit fluid flow through the downhole tool. At least one fly wheel is positioned within the outer tubular housing. The fly wheel comprises a center of mass.

A plurality of fins may be operatively connected to the fly wheel and positioned within the fluid path to receive energy from fluid flow through the flow path whereby the at least one fly wheel is rotated. The plurality of fins may rotate as the fly wheel rotates.

A mounting for the fly wheel controls a center of rotation of the fly wheel. In one embodiment, the center of mass of the fly wheel is offset from the center of rotation, which results in vibrations being created during rotation of the fly wheel.

The propulsion generator might comprise a first fly wheel housing in which the mounting is provided for a first fly wheel. A second fly wheel may be mounted within a second fly wheel housing whereby a second center of mass of the second fly wheel is offset from a center of rotation of the second fly wheel. The first fly wheel housing and the second fly wheel housing define at least a portion of the fluid flow path through the outer tubular housing.

In one possible embodiment, the propulsion generator may comprise that the second fly wheel housing is substantially identical to the first fly wheel housing. The propulsion generator may further comprise connectors to mount the first fly wheel housing to the second fly wheel housing. In one embodiment, the connectors are operable for mounting the first fly wheel housing and the second fly wheel housing at different orientations with respect to each other whereby the at least one fly wheel is selectively oriented the same or differently from the at least one second fly wheel housing.

In one embodiment, the plurality of fins are positioned with respect to the fluid flow path such that during operation as a fly wheel rotates that the amount of variation of instantaneous fluid flow through any particular cross-section of the fluid flow path does not vary by more than 30% than an average fluid flow through the cross-section of the fluid flow path.

A propulsion generator may further comprise a plurality of bearing members for mounting the fly wheel. The plurality of bearings may comprise an outer bearing with an outer bearing circumference. The plurality of bearings may be constructed asymetrically to produce a center of rotation of the fly wheel, which is offset from a center of the average circumference of the fly wheel and/or otherwise whereby the center of mass is offset from the center of rotation of the fly wheel.

In one possible embodiment, a propulsion generator may comprise a shaft for the fly wheel centrally positioned with respect to the average circumference of the fly wheel. The bearings may comprise an inner bearing and an outer bearing, the outer bearing may comprise a circular outer circumference, and the inner bearing may support the shaft such that a center of the shaft is offset from a center of the circular circumference.

In another embodiment, a propulsion generator may comprise a shaft for a fly wheel, which comprises a cylindrical shaft with centrally positioned axis. In this embodiment, the shaft axis may be positioned offset from a center of an average radius and/or average circumference of the fly wheel and/or center of mass of the fly wheel.

A propulsion generator may comprise a timing wheel which is mounted within the outer tubular housing whereby a center of mass of the timing wheel and a center of rotation of the timing wheel are coincident.

In another embodiment of the invention, a method for making a propulsion generator may comprise steps such as, but not limited to, providing an outer tubular housing for the downhole tool, providing that the outer tubular housing defines a fluid flow path through the tubular housing to permit fluid flow there through, providing at least one fly wheel within the outer tubular housing with a center of mass.

Other steps may comprise providing that the fly wheel receives energy for rotation in response to fluid flow through the fluid flow path and providing that the mounting for the at least one fly wheel controls a center of rotation of the fly wheel. The center of mass of the fly wheel is offset from the center of rotation, which results in vibrations being created during rotation of the at least one fly wheel.

The method may further comprise providing a first fly wheel housing for a first fly wheel, providing a second fly wheel housing for mounting a second fly wheel, and/or providing that a center of mass for the second fly wheel is different from a center of mass of the second fly wheel. Other steps may comprise providing that the second fly wheel receives energy for rotation in response to fluid flow through the fluid flow path.

The method may further comprise utilizing connectors operable for mounting the first fly wheel housing and the second fly wheel housing at different orientations with respect to each other whereby the at least one fly wheel is selectively oriented the same or differently from the at least one second fly wheel housing.

The method may further comprise providing bearings to produce a center of rotation of the at least one fly wheel which is offset from a center of an average circumference of the at least one fly wheel.

The method may further comprise utilizing a shaft for the one fly wheel which is centrally positioned within or at the center of mass of the fly wheel and/or with respect to an average circumference of the fly wheel, and further utilizing an inner bearing and an outer bearing wherein the outer bearing comprises a circular circumference. In this embodiment, the inner bearing supports the shaft such that a center of the shaft is offset from a center of the circular circumference.

Another method may comprise utilizing a shaft for a fly wheel which is positioned at a position offset from a center of the fly wheel with respect to an average outer circumference and/or center of mass of the fly wheel.

In another embodiment, a method may comprise utilizing a second wheel which may comprise a plurality of fins that are positioned to engage fluid flow through the fluid flow path, and providing that a center of mass of the second wheel coincides with a center of rotation of the second wheel thus controlling, timing, averaging, smoothing, delaying, or other affecting the fluid flow through the propulsion generator.

In one possible embodiment, a method may comprise that the propulsion generator is constructed so that that the amount of variation of instantaneous fluid flow through any cross-section of a fluid flow path leading to or away from the fly wheel does not vary by more than 30% than an average fluid flow through the same cross-section of the fluid flow path.

In yet another embodiment, a propulsion generator may comprise one or more elements such as, but no limited to, a first fly wheel housing mounted to the string of pipe, a second fly wheel housing mounted to the string of pipe, a first fly wheel mounted in the first fly wheel housing, a second fly wheel mounted in the second fly wheel housing.

A first mounting for the first fly wheel may be utilized that controls or constrains or supports a center of rotation of first fly wheel, whereby the center of mass of the first fly wheel is offset from the center of rotation, which results in vibrations being created during rotation of the first fly wheel.

A second mounting for the second fly wheel may be utilized that controls a center of rotation of the second fly wheel, whereby the center of mass of the second fly wheel is offset from the center of rotation, which results in vibrations being created during rotation of the first second fly wheel.

In one embodiment, the first fly wheel housing and the second fly wheel housing define a fluid flow path through the the first fly wheel housing and the second fly wheel housing.

The propulsion generator may further comprise a third housing mounted to the string of pipe, a third wheel within the third wheel housing, a third wheel mounting for the third wheel which controls a center of rotation of the third wheel, whereby the center of mass of the third wheel coincides with the center of rotation of the third wheel, which may be a timing wheel as discussed herein and/or another fly wheel.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF THE PREFERRED EMBODIMENT

Figure 3A:
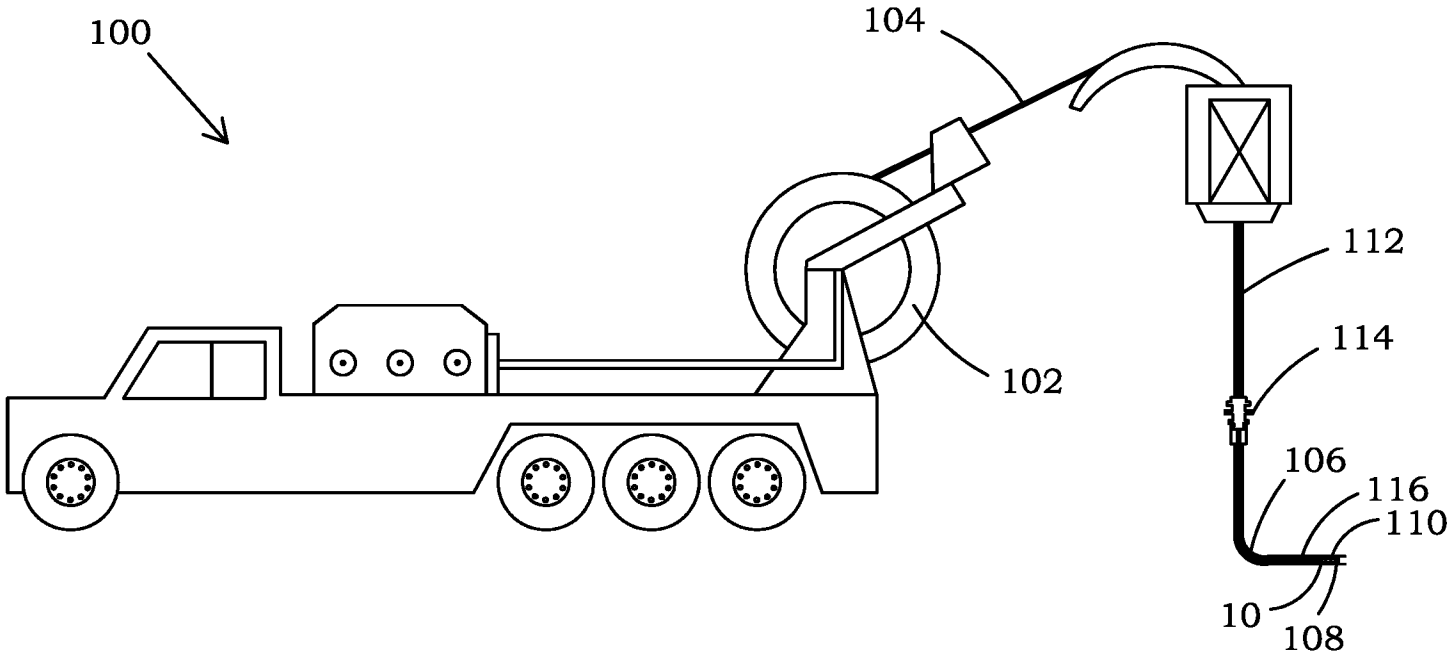
FIG. 3A is a schematic showing a coiled tubing unit having a pipe string and bottom hole assembly within a angled wellbore in accord with one possible embodiment of the present invention.

Referring now to the drawings, and more particularly to FIG. 3A, there is shown drilling system 100, which in this embodiment comprises coiled tubing unit 102. However, the present invention may be utilized with other types of drilling systems and/or workover systems including rotary drilling systems and the like. The present invention is especially useful for providing propulsion to coil tubing units because the coil tubing cannot be rotated.

In this embodiment, tubular string 104 goes into wellbore 106 and includes bottom hole assembly 108. As discussed earlier, due to the high angle wellbore portion as indicated at 116, or horizontal wellbore portion as indicated at 118, and/or other factors, bottom hole assembly 108 may no longer be readily movable outwardly to a greater depth. It will be noted that depth as used herein may include not only vertical depth but also distance of a more extended range, either vertical or horizontal or therebetween of length of pipe within the borehole. If tubular string 104 is being used for drilling, and includes a drill bit 110, then drilling may have effectively stopped due to the inability to move bottom hole assembly 108 deeper or more laterally. It will also be appreciated by one of skill that the tubular string is more susceptible to becoming stuck in the wellbore due to these conditions for many reasons including but not limited to differential sticking, tight portions of the bore hole, expanding formations in contact with drilling fluids, and the like. Propulsion tool 10 of the present invention may be incorporated or connected into bottom assembly 108, which is at a lower end of pipe 104, as shown in FIG. 3A to provide propulsion or movement of greater depth to drill string 104 and drill bit 110 and/or for removing or partially withdrawing drill string 104 from borehole 106.

Figure 3B:
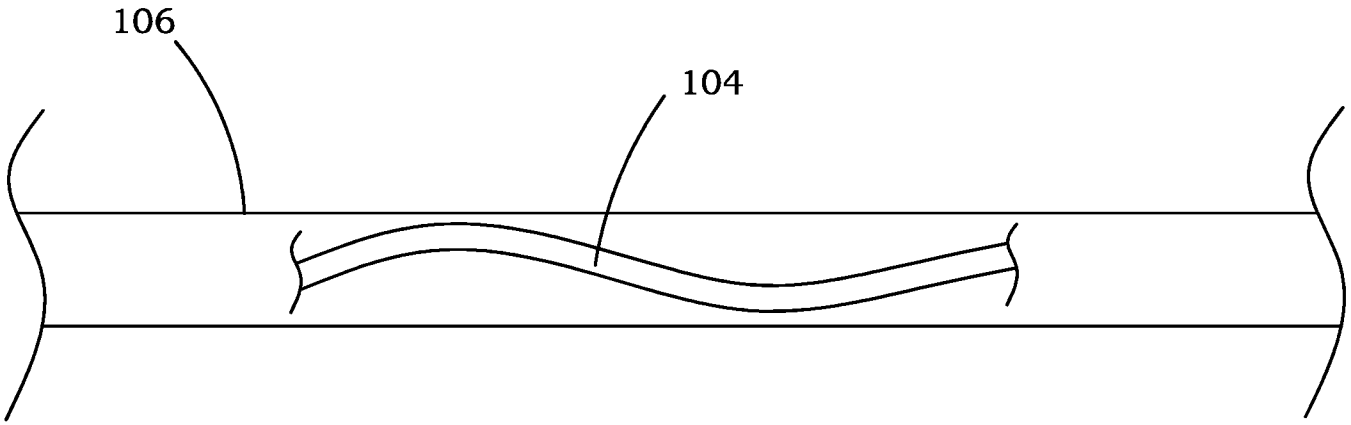
FIG. 3B is a sectional view, showing drill pipe or coiled tubing spiraled, coiled, or otherwise compressed within a well bore and/or casing.

FIG. 3B shows tubular string 104 spiraled, coiled, and/or compressed within wellbore 106. The added friction of increased contact between the tubular string and the wellbore wall increases the likelihood of sticking or difficulty in moving the bottom hole assembly downward.

Tubing drilling or workover system 100 may also comprise riser pipe or lubricator 112 and well head valve 114, which would allow bottom hole assembly 108 to be pulled into lubricator 112, and valve 114 closed, so that if wellbore 106 is under pressure or potentially under pressure, then the entire assembly could be removed under pressure, if desired. Another advantage of propulsion tool 10 of the present invention is a relatively short length so that bottom hole assembly 108, propulsion tool 10 and bit 110 may fit within the limitations of the length of lubricator 112. It will be understood that there are often significant practical limitations to the length of lubricator or riser pipe 112.

Bottom hole assembly 108 may comprise a mud motor for rotating drill bit 110 and/or other components. In a preferred embodiment of the present invention, propulsion tool 10 is mounted in bottom hole assembly 108 and can be operated by drilling mud, mud co-mingled with nitrogen, any suitable combination of gas or air or drilling mud or fluids, and the like used for drilling, which are referred to herein collectively as drilling fluid. If desired, the drilling fluids can even be changed during drilling, e.g., changing from air and/or other gasses to water and/or other liquids as the drilling fluid. Typically, as discussed hereinafter, the drilling fluid flows through the bottom hole assembly and is recirculated back up wellbore 106 outside of tubing string 104. Accordingly, tool 10 may, if desired, be continuously powered by continuously flowing recirculated drilling fluid flow.

As another feature, fluid flow through the tool is never completely shut off. Thus, fly wheels 36 and/or timing wheel 70 are positioned such that if these wheels freeze up or otherwise fail, then circulation through tool 10 is not lost. Moreover, during operation fluid flow through tool 10 remains substantially constant.

This feature of the tool provides significant advantages. For example, if the drill string is still advancing, then drilling might continue. This feature causes less problems for drilling motors and turbines in bottom hole assembly 108. As well, because circulation can be maintained, the drilling string may be removed more easily and/or the mud can be changed for pressure control, and the like. Circulation is normally an important factor for keeping a well bore from being damaged and the present propulsion tool, in a presently preferred embodiment, is designed so that the tool does not shut off fluid flow through the drill string at any time. Moreover, circulation fluid flow through tool is substantially constant.

In other words, instantaneous velocity of fluid and/or instantaneous amount of fluid flowing as compared to average velocity and/or instantaneous amount of fluid flow through any particular cross-section of the fluid flow path entering or leaving fly wheel 36 or timing wheel 70 during normal operation does not vary by more than 50%, and may vary less than 40%, or less than 30%, or less than 20%, or less than 10%. More specifically, the variation in instantaneous velocity of fluid and/or instantaneous amount of fluid flow as compared to average velocity or amount of fluid through reduced diameter passageways, such as passageway 28 entering fly wheel 28 or passageway 76 directly prior to entering timing wheel 70 is relatively small, such as less than a variation of 30%, or less than 20%, or less than 10%, or less than 5%. Timing wheel 70 may be utilized to provide a delay or accumulator effect so that the fluid flow through tool 10 is relatively continuous so as to provide even less disruption to mud motors or turbines within bottom hole assembly 108.

Figure 1:
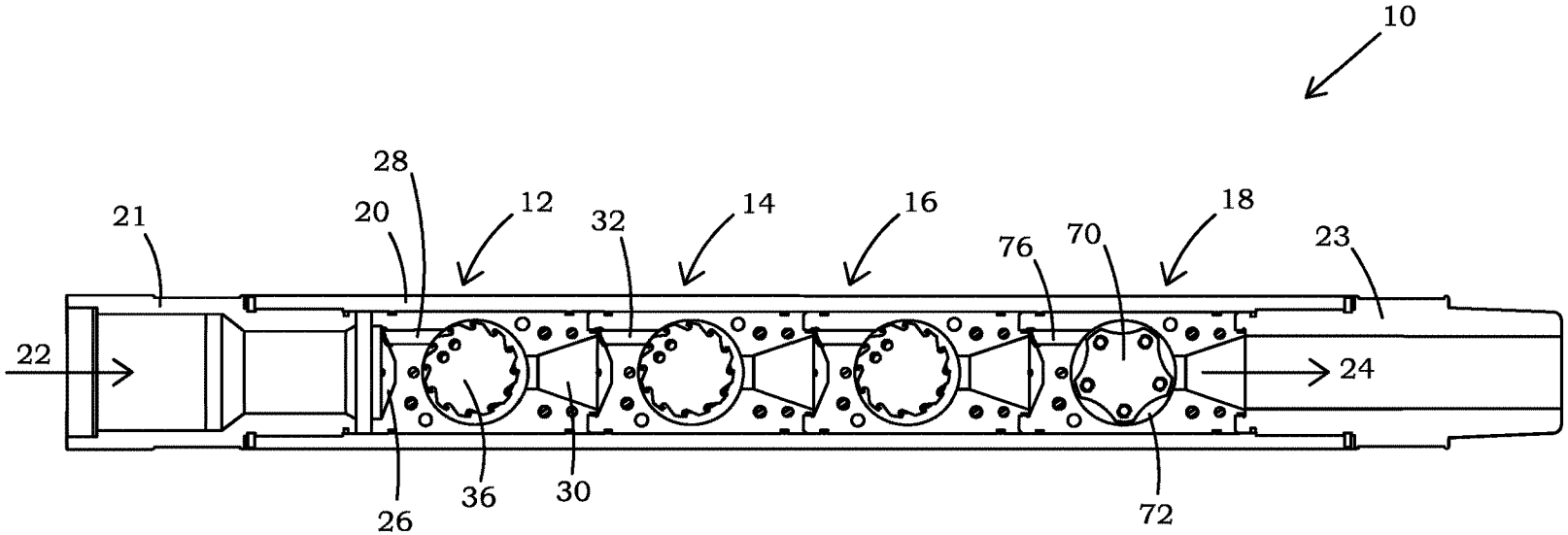
FIG. 1 is a side elevational view, partially in section, which discloses a multiple section propulsion tool in accord with one possible embodiment of the invention.

Referring now to FIG. 1, there is shown multiple section propulsion tool 10, in accord with one possible embodiment of the present invention. In this embodiment, tool 10 comprises three gyro harmonic oscillation wheel sections 12, 14, and 16. It will be noted that the frequencies of operation may or may not include selected harmonic frequencies although the effects of tool operation can be more pronounced at those frequencies and/or resonance frequencies, as discussed hereinafter.

Propulsion tool 10 may also comprise at least one timing wheel section 18. Gyro harmonic oscillation wheel sections 12, 14, 16, and timing wheel section 18 are mounted within tubular housing 20. Sections 12, 14, 16, and 18 are bolted together and can be rotationally oriented with respect to each other at different selectable angles with respect to each other although in this embodiment each section is angularly oriented the same. Top sub 21 and bottom sub 23 secure the sections within tubular housing 20, connect with the coiled tubing, drill pipe, or the like, and direct drilling fluid flow through sections 12, 14, 16 and 18. The housings for each section 12, 14, 16, and 18 may be substantially the same for advantageously reducing manufacturing costs, providing redundancy for quick repair, and so forth.

Drilling fluid is pumped or recirculated through the tubing or coiled tubing to the bottom hole assembly, as discussed hereinbefore. Drilling fluid enters tool 10 as indicated by arrow 22 and exits tool 10 as indicated by arrow 24. The fluid path components comprise chambers interconnected with tubulars, which are shaped to provide a laminar style flow through tool 10 entering the fly wheels 36 and/or timing wheel 70, which reduces turbulence for smoother operation. Chamber 26 may comprise a dome structure 27 and/or inverted dome structure 29 (See FIG. 2B) that imparts a swirl to the drilling fluid whereby the drilling fluid enters tubular 28, which leads to gyro harmonic oscillation wheel 36, which may also be referred to as fly wheel 36 herein. Fluting or the like (not shown) within the dome structures might also be utilized to direct and/or swirl the fluid.

After passing by fly wheel 36, the fluid output flow out of gyro harmonic wheel section 12 may preferably go through expansion chamber 30, which provides reduced back pressure for more efficient fluid flow past fly wheel 36 and then swirling or laminar flow through reduced diameter tubular 32 shown in FIG. 1, which focuses the drilling fluid onto the next gyro harmonic wheel to increase energy transfer to fly wheels 36 from the fluid flow while maintaining a relatively constant fluid flow through tool 10 to protect drilling motors and/or turbines in bottom hole assembly 108 as discussed hereinbefore. This type of fluid flow passageway profile may be repeated for each section 12, 14, 16 and, if desired, also timing section 18. There may be more or fewer sections as desired, as discussed in more detail hereinafter.

Figure 2A:
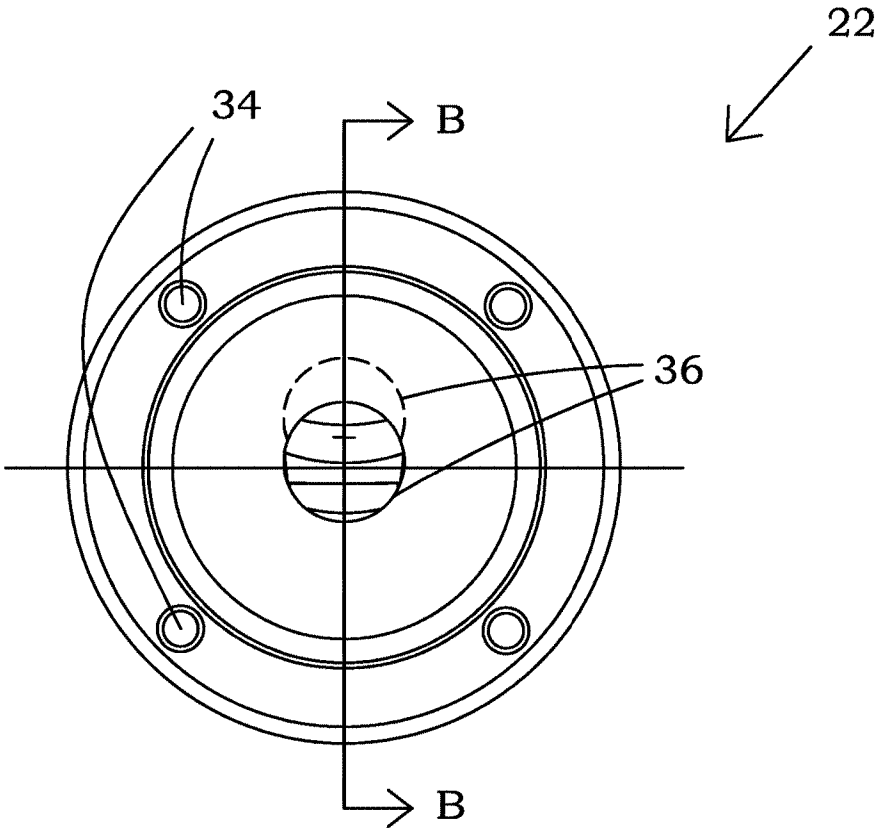
FIG. 2A is an enlarged front elevational view, partially in section, of a single fly wheel section from the propulsion tool of FIG. 1, in accord with one possible embodiment of the invention.
Figure 2B:
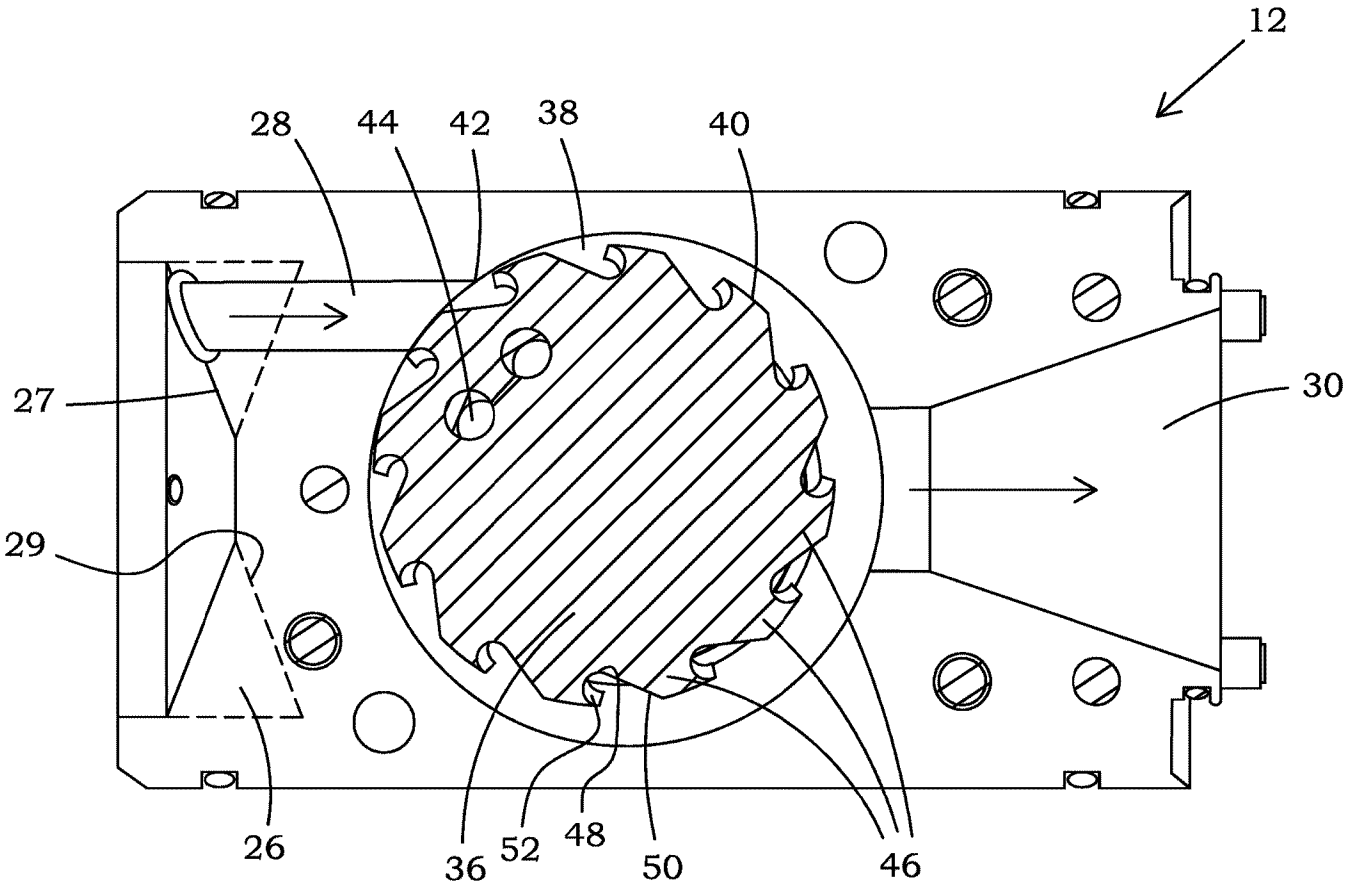
FIG. 2B is an enlarged side elevational view, partially in section, taken along lines B-B of FIG. 2A, in accord with one possible embodiment of the invention.

Referring to FIG. 2A and FIG. 2B, there is shown gyro harmonic wheel section 12, which may be representative of sections 12, 14 and 16. While the present drawings are not intended to manufacturing level drawings, and there may be differences with the manufactured versions of propulsion tool 10, in one embodiment, the gyro harmonic wheel sections may advantageously be identical to each other for reasons such as those discussed hereinbefore. Any desired number of gyro harmonic wheel sections may be utilized in tool 10. The gyro harmonic wheel sections are conveniently mounted to each other with any number of fasteners, guides, or connectors such as connectors 34. Because the fluid flow lines will match up regardless of orientation, sections 12, 14, 16 and 18 can be rotated to a desired orientation with respect to each other. For example, a fly wheel in one section may be parallel to, at right angles with, upside down, or otherwise oriented with respect to a fly wheel or timing wheel in another section. Other mounting and orientation means, such as screws, clamps, or the like, may be provided as desired for angularly orienting the sections with respect to each other to increase the number of possible orientations.

Referring to FIG. 2A, fly wheel 36 oscillates or moves, as discussed in detail hereinafter, in response to rotation as indicated by solid and dashed lines representing fly wheel 36, which solid and dashed lines may be exaggerated in the drawing for effect.

Figure 7:
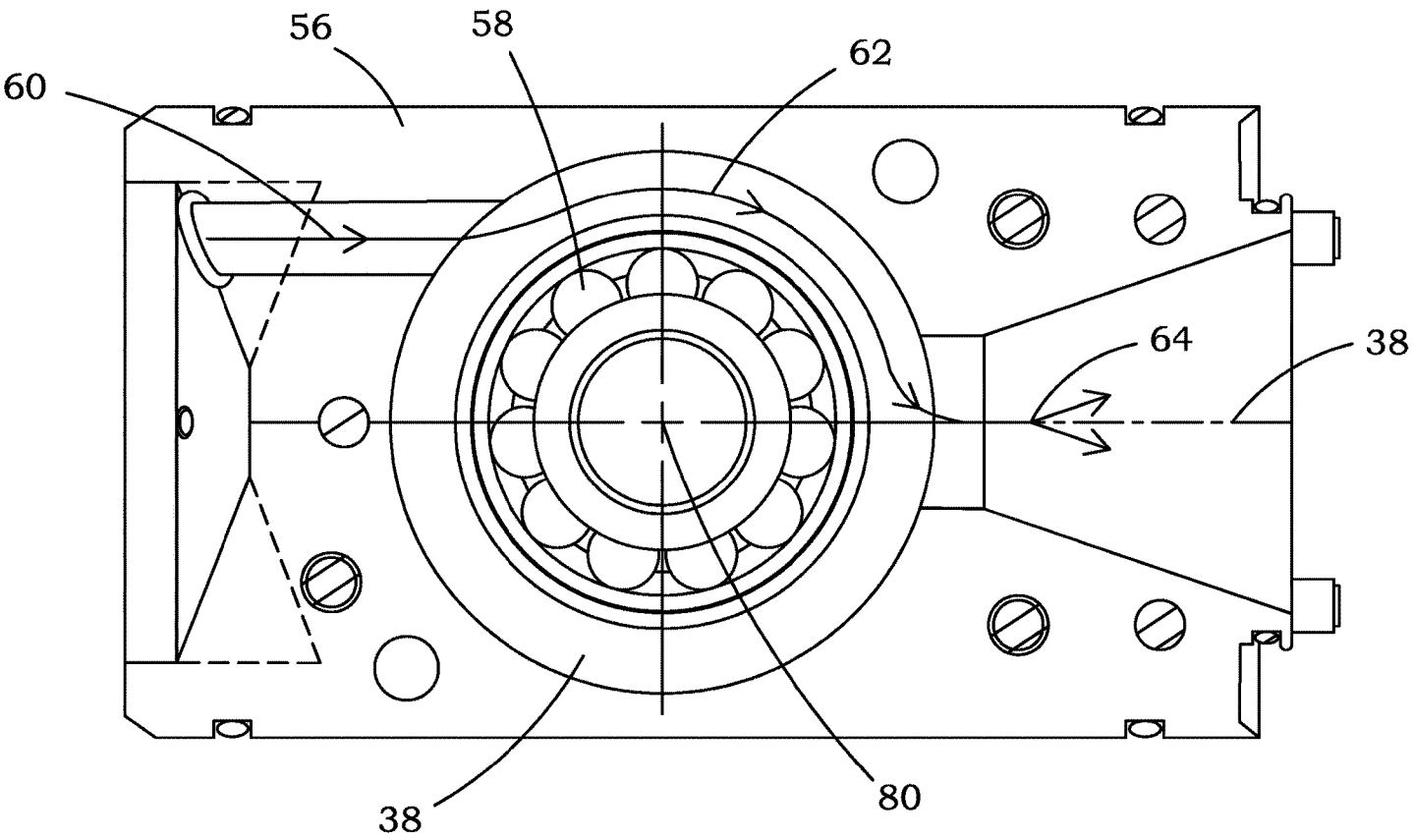
FIG. 7 is an enlarged side elevational view of a timing wheel section from FIG. 1 in accord with one possible embodiment of the present invention.

Fly wheel 36 (which may sometimes also be referred to herein as a gyro wheel) is representative of the other fly wheels used in the gyro harmonic wheel sections 12, 14, and 16, and/or other harmonic wheel sections. However, different sized or mounted fly wheels may be utilized, if desired. In one embodiment, fly wheel 36 is preferably mounted off the center line of tool 10 and is preferably decentralized within fly wheel chamber 38. In a presently preferred embodiment, the center of mass of the fly wheel may be offset from the center of rotation of the fly wheel by various means some of which are discussed herein so that the fly wheel produces vibration. However, the various means for producing vibration are not limited to those discussed herein. Fly wheel chamber 38 is preferably cylindrical as shown in FIG. 7, which shows fly wheel 36 removed wherein one possible outer roller bearing assembly 58 is disclosed. In this embodiment, bearing assembly 58 comprises one or more circular outer bearing members or races 59, which comprise a circular circumference that mounts within an interior and/or end portions of cylindrical fly wheel chamber 38.

Fly wheel 36 has an outermost diameter that may, in one embodiment, be about 80-90 percent of the circumference of cylindrical fly wheel chamber 38. The fly wheel chamber may typically have a diameter 40-75% or typically 55-65% of the tool diameter. Fly wheel 36 has a thickness of 10% to 30% of tool 10. The invention is not limited to this particular arrangement but is presently preferred. Furthermore, in this embodiment, fly wheel 36 is preferably offset within wheel chamber 38. The size/mass of fly wheel 36, typically comprised of steel, produces a gyroscopic effect during rotational operation of fly wheel 36, which may enhance propulsion produced by tool 10.

As discussed herein, the fly wheel may be mounted so that the center of mass is offset from the center of rotation by various means including an offset mounted shaft and/or offset bearing mountings and/or offset mounted weights. In FIG. 2B, outermost surface or outermost circumference 40 of fly wheel 36 is positioned more closely to wall 42 of fly wheel chamber 38 adjacent fluid inlet 28. Outer surface or circumference 40 of fly wheel 36 may have a greater offset from wall 42 of fly wheel chamber 38 adjacent outlet 30 for maximizing the fluid flow force through the housing and minimizing back pressure.

Figure 4:
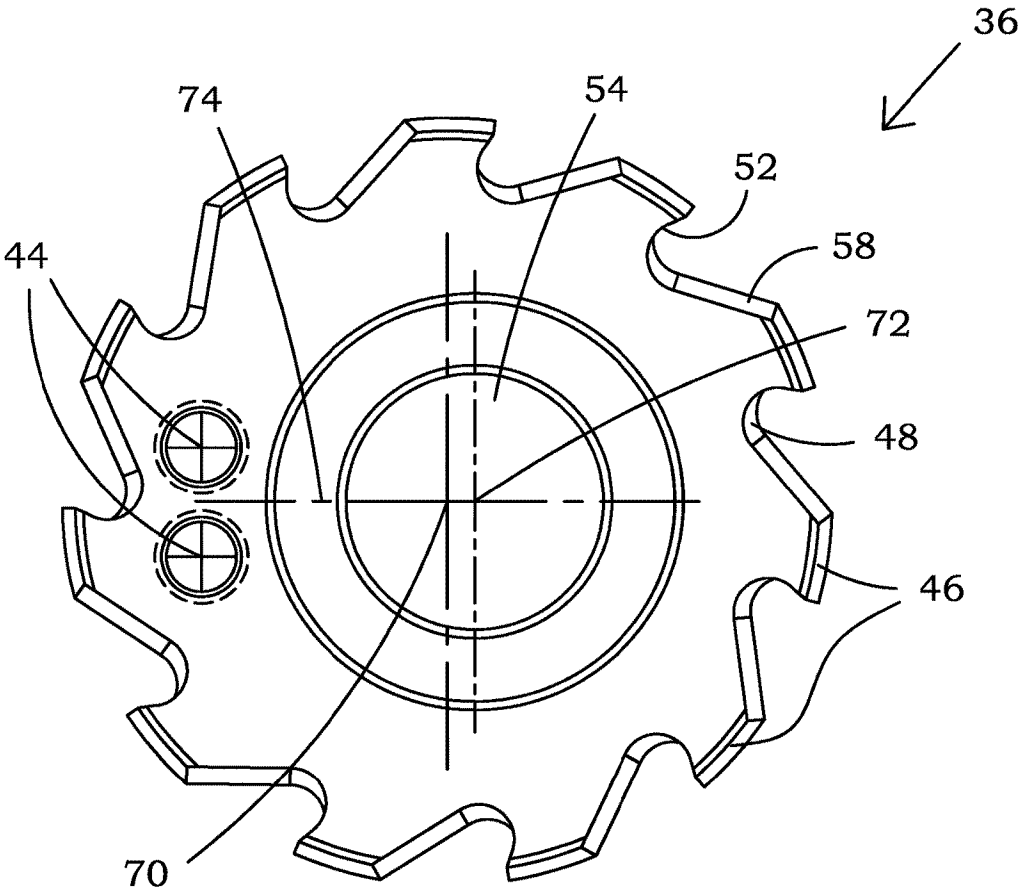
FIG. 4 is a side elevational view of a fly wheel in accord with one possible embodiment of the present invention.
Figure 11:
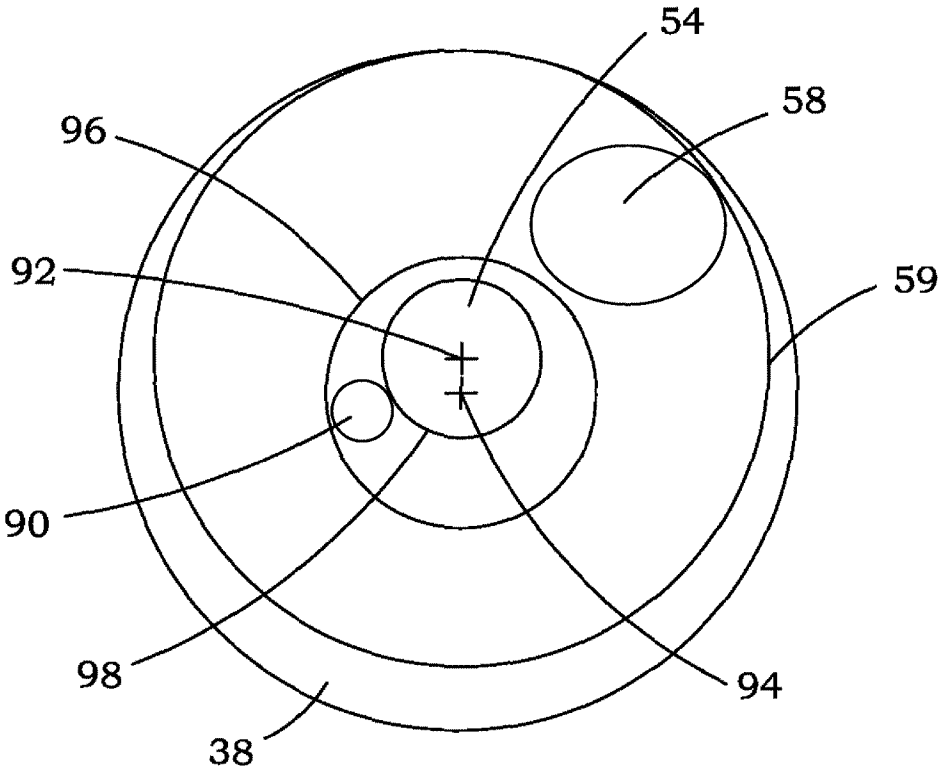
FIG. 11 is a solid bearing inner race with offset for use with a fly wheel in accord with one embodiment of the invention.

Referring to FIG. 2A, FIG. 2B, FIG. 4, and/or FIG. 11, in one possible embodiment, the offset mounting of flywheel 36, as discussed herein, will cause the clearance between wall 42 and outermost circumference 40 of flywheel 36 to change repetitively during rotation of flywheel 36. In this embodiment, the change in clearance will change the fluid flow velocity and energy received by flywheel 36. Accordingly, in this embodiment, flywheel 36 can be made to vary and/or repetitively change and/or continuously change in rotational speed and/or acceleration, speeding up and slowing down. The speed and/or the acceleration change due to this effect may be substantially repetitive and/or variable and/or continuous during each rotation of flywheel 36. The change in fluid velocity and energy received by flywheel 36 may be quite large depending on the change in clearance with respect to wall 42. For example, for a small minimum clearance, the change from minimum to maximum clearance might easily be, for example only, a factor of 100 to 1000. The mass of a flywheel, the amount of change in clearance with respect to wall 42, the types of fins, the type of drilling fluid, and other factors such as these can be utilized to create a desired amount of continuously and/or repetitively varying speed and/or varying acceleration of rotational speed of one or more flywheels 36 in propulsion tool 10.

The mounting of fly wheel 36 may also be offset from the centerline of tool 10, which is the axis of tubular housing 20. The offsets may be in the range of 0.005 to 0.5. For example, for a particular coiled tubing size, the offset might be 70 thousandth of an inch. However, this offset can be changed as desired. In one embodiment, this offset may be changed by simply changing the bearings. Offsets may be changed in increments of one thousandths, two-thousandths, five-thousands, ten-thousandths or the like as desired. The offset for a particular design may be in a range of plus or minus one thousandths, two-thousandths, five-thousands, ten-thousandths, or the like as desired.

In accord with various embodiments of the present invention, offsets may be created in different ways. In one embodiment, perhaps best shown in FIG. 4, it will be seen that shaft 54, which is cylindrical, is offset with respect to the average outer circumference or average radius of fly wheel 36, whereby the actual center point of mass and/or center of the average circumference of fly wheel 36 is shown at 70. However, the center point of cylindrical shaft 54 is at 72. The center of mass of cylindrical shaft 54, in this example is also at 72 and assumes a uniform shaft. In this embodiment, the center of shaft 54 is offset from the center point and also the center of gravity or mass of fly wheel 36. In other words, shaft 54 is mounted by the bearings 58 (shown in FIG. 7) to fly wheel 36 at a position offset from the center 70 of mass and/or center of average radius or average circumference of fly wheel 36. In this embodiment, but not in other embodiments discussed hereinafter, the center point of the bearings will be at or along the center point of the housings and tool 10 axial line, as shown in FIG. 7 at center point 80 (shown in FIG. 7) which coincides with tool 20 center line 82. In one embodiment, centerpoint 72 may or may not coincide with centerpoint 80, depending on the selectably desired positioning of flywheel 36 within chamber 38, which was also discussed hereinbefore.

However, offsets that may be utilized to create vibrations during rotation of flywheel 36, in accord with other embodiment of the present invention, may be created in other ways. As one example, an offset may be created using the bearing mountings rather than an offset flywheel shaft 54. For example, in FIG. 11, inner race 90 may be utilized with a solid bearing for mounting shaft 54 of fly wheel 36. In this example, cylindrical shaft 54 may be centralized on fly wheel 36 so that the center of mass of fly wheel 36 and shaft 54 coincide with the physical center of shaft 54 at 92. Outer circumference (race) 96 of inner bearing 90 engages the outer bearing race which may be of various types (see for example roller/ball/frictionless bearings 58 in FIG. 7).

Referring again to FIG. 11, it will be seen that round circumference (race) 98 within inner bearing 90 (which contains cylindrical shaft 54) is not mounted concentrically with respect to outer circumference (race) 96 of inner bearing 90. Instead, the center of inner bearing 90 is at 94. (These distances may be shown exaggerated in FIG. 11 for illustration purposes). Accordingly, outer bearing 58 (which may or may not be solid, roller, ball, frictionless or the like), and the circumference (race) 59 of outer bearing may or may not be centered or concentric around the center point 80 of the housing and/or as shown in FIG. 7. However, regardless, shaft 54 and fly wheel 36 will be offset due to the offset location of circumference (race) 98 within inner bearing with respect to the center of mass being offset from the center of rotation of fly wheel 36. Conceivably, the offset could also be formed in the outer bearing instead of the inner bearing and/or in both the inner and outer bearings. Suitable cylindrical support is insertable and/or machined within housing 56 for the bearing configuration of choice.

Other means of providing offsets of mass with respect to the center of mass of fly wheel 36 could also be utilized whereby the center of mass of the fly wheel is offset from the center of rotation to produce vibration as the fly wheel rotates. Moreover, by simply changing inner and/or outer bearing members, the position of circumference 98 (race) (which contains shaft 54) within inner bearing 90, the offset may be changed making it possible to relatively easily vary the desired offset as desired, without any significant machining. It will also be noted that shaft 54 and the interior of inner bearing (race) 96 need not be cylindrical but could be shaped otherwise to mate with and secure shaft 54 within inner bearing (race) 96.

In yet another possible embodiment, it will be appreciated that weights 44 (See FIGS. 4 and 5) and/or additional weights, and/or the absence of weights, and/or other offset features will change the center of mass of fly wheel 36 whereby fly wheel 36 may be mounted centered or not, while still producing vibrations due to a center of mass offset from a center of rotation. For example, all bearings could be centralized, the shaft centralized, so that without the weight, then center of mass would coincide with the center of rotation. However, with weights 44 added (or material removed), then the mass will be offset from the center of rotation to create vibration. Weights may also be added to an already offset mass configuration. Accordingly, it will be appreciated that offset weights 44 (see e.g. FIG. 4), if used, may be utilized to create and/or augment vibrations. Thus, bearings may be changed, weights may be changed, physical elements of the fly wheel may be changed, and/or other changes made to offset the center of mass with respect to the center of rotation of fly wheel 36 in accord with one possible embodiment of the present invention.

In the above-described embodiment, weights 44 are offset by a distance of 30% to 70% of the radius of fly wheel 36 from fly wheel center of mass 70. The mass and radial position may be utilized to increase or decrease vibrational motion amplitude. In this embodiment, it will be seen that two weights 44 are provided, whose effective mass center is in line with the offset of shaft 54, as indicated by line 74. Accordingly, the vibrational force of weights 44 (if used) will be synchronized with the vibrational force due to the offset shaft 54. Accordingly, various types of center of mass/center of rotation offsets may be utilized to create the desired vibrations of the present invention by moving the center of mass with respect to the center of rotation.

Figure 12:
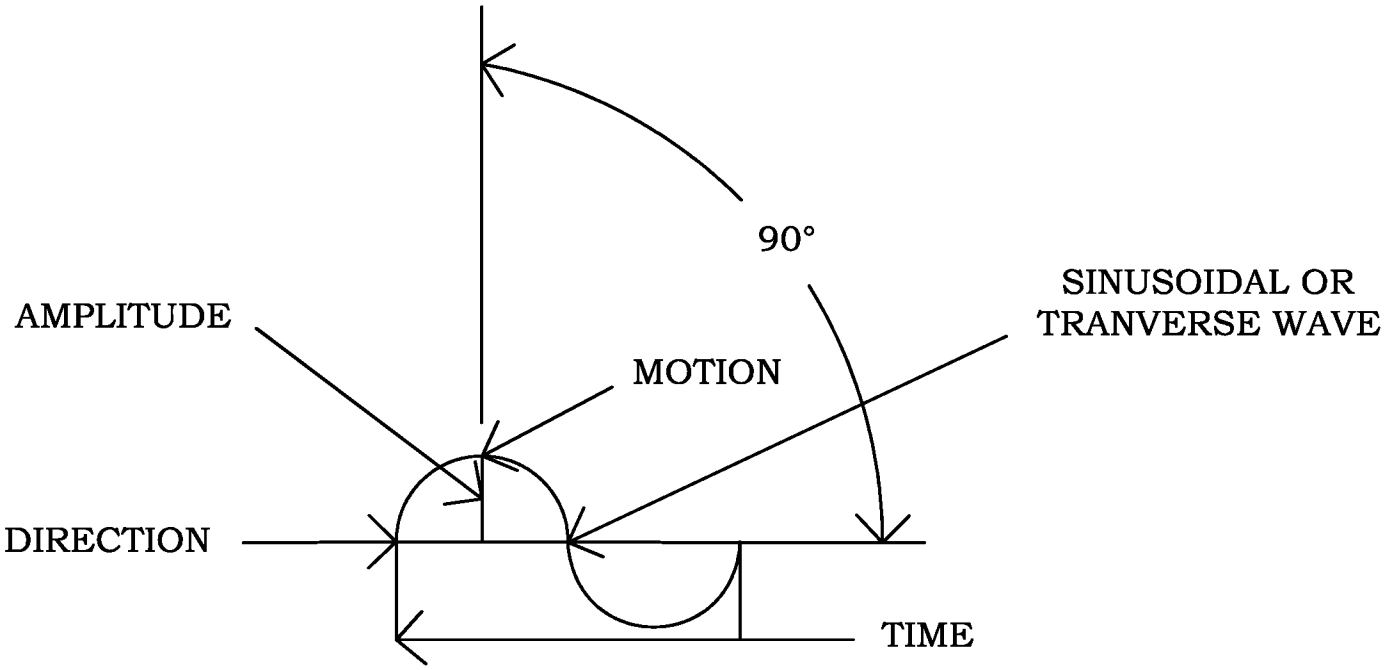
FIG. 12 shows a sine wave of vibrational motion amplitude versus time in accord with one possible embodiment of the present invention.

This construction creates vibration or oscillation in each gyro harmonic wheel section as each fly wheel 36 rotates. The vibration or oscillation movement in tool 10 versus time can, in one possible embodiment, be described as a sine wave, such as the sine wave of FIG. 12, wherein at least one of amplitude, frequency, and wavelength can be varied by changing the wheel center mounting offset from the axis of tool 10 and/or offset in the individual housing and/or the number of teeth in fly wheel 36 and/or changing the weights 44 and/or by changing the relative position of fly wheel 36 within fly wheel chamber 30 and/or changing the fluid flow rate and/or mud weight and viscosity and/or by adjusting the timing wheel 70, as discussed hereinafter. Weights 44 may be made heavier are lighter or removed, if desired. During operation, the frequency may also be changed by altering the drilling fluid flow rate, which is controlled from the surface.

In another embodiment, if desired, the frequency may be adjusted so as to be resonant or harmonic with respect to the drill pipe coiled tubing. The resonant frequency may be chosen based on the size and/or type of drilling pipe. A system as a whole may have a harmonic frequency at which it would oscillate if energy were applied. At the resonant frequency, the drill pipe (or some portion of the drill pipe) may be induced to vibrate considerably more strongly than would occur if the frequency were off the resonant frequency. However, the tool is operable over a wide range of frequencies and harmonic and/or resonant frequency operation is not required for tool operation but may be selectively utilized as yet another means for increasing/decreasing propulsion effects of tool 10.

When a semi-elastic body is subjected to axial strain, as in the stretching of a length of pipe, the diameter of the pipe will contract. When the pipe is under compression, the diameter will expand. Since a length of pipe is subjected to vibration, it will also experience alternate tensile and compressive waves along the longitudinal axis of the pipe. This can result in the pipe momentarily being free during the undulations of the pipe. The surrounding bonded area at the point of contact with the pipe is also subjected to the undulating waves, thereby momentarily reducing the differential sticking pressure of the formation to the pipe. Another factor in reducing stuck tubular situations is acceleration of the pipe. A vibration stroke of only one inch will greatly enhance the reduction of friction along the entire tubular length of the drill pipe. Moreover, in conjunction with tension applied by reel 102, rotational force of bit 110, variation in pump flow, and operation of tool 10, heavy weight sections where used in the pipe, overall pipe weight, jars, and/or other means, the pipe may be moved either downwardly or upwardly as desired.

Figure 5:
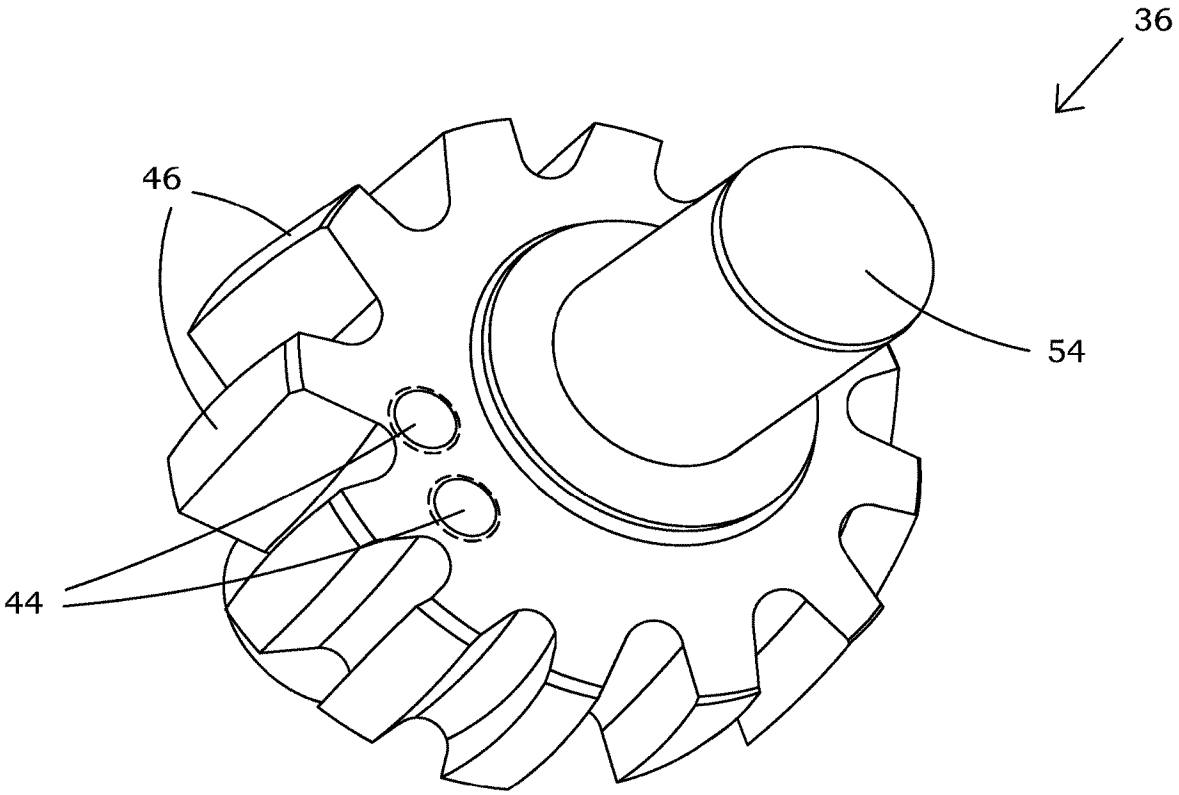
FIG. 5 is another perspective view of the fly wheel of FIG. 4 in accord with one possible embodiment of the invention.
Figure 6:
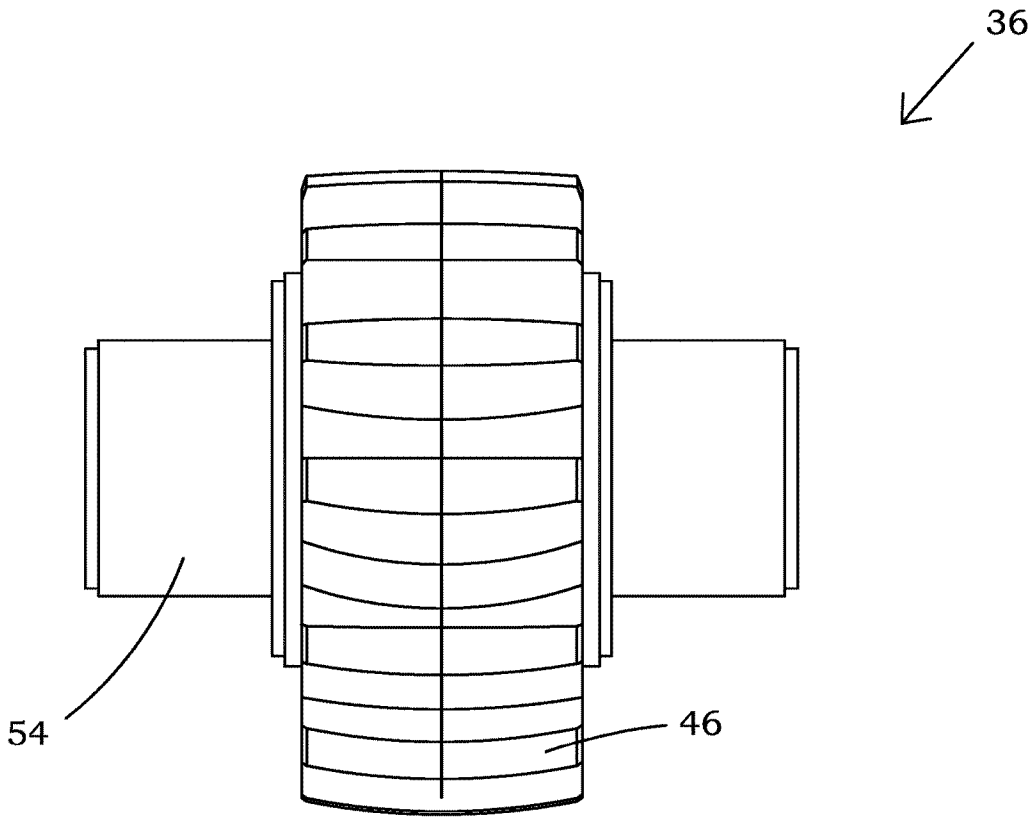
FIG. 6 is a front elevational view of the fly wheel of FIG. 4 in accord with one possible embodiment of the present invention.

One possible embodiment of fly wheel 36 is shown enlarged in various views in FIG. 4, FIG. 5, and FIG. 6. Fly wheel 36 is rotated in response to drilling fluid flow as discussed above and produces a gyroscopic effect due to the rotation. The gyroscopic effect and vibration created by fly wheel operation have been found to not only resist sticking but also provide propulsion of the bit even in high angle holes. While the center of mass of fly wheel 36 is moved away from the center line of tool 20, fly wheel 36 is preferably symmetrical so that the gyroscopic effect is more focused. It is believed that these factors, along with the inherent weight of the bottom hole assembly (assuming at least some angle of the bore hole), and/or other factors discussed herein, can be especially significant in moving the drilling bit downward, upward, forward, laterally, and/or the like.

To maximize the gyroscopic effect, the fly wheel dimensions may be matched to the coiled tubing size so that the fly wheel may have a diameter of 40% to 80% of the internal diameter (ID) of the tubing and may preferably be in a range of 60% to 70% of the pipe ID. The width may be in the range of 5% to 40% and may be preferably 10% to 20%, while keeping the shaft sized for reliable mounting. Shaft 54 diameter may be in the range of 20% to 40% of the fly wheel diameter and may have a length of 70% to 120% of the fly wheel diameter. Fly wheel 36 may comprise steel or may comprise heavier materials or components or weights, if desired.

It will also be noted that the fly wheels in different sections may be the same or may be different, such as by the number of teeth 46, the outer diameter, the offset, or dimensions or features discussed hereinbefore.

Referring to the possible embodiments shown in FIG. 2B and/or FIG. 4, teeth 46 have a contour of the outer radius, which largely coincides with the radius of the circumference of the circle that defines the outer boundaries of fly wheel 36. Each tooth has a width, which may act to trap fluid and transfer fluid energy to fly wheel 36 as the wheel rotates. A pocket 48 is formed between teeth that is designed and oriented to catch and momentarily trap the drilling fluid and the force of drilling fluid flow. Accordingly, wall 58 is sloping more gradually, and in this embodiment, is longer that wall 52 with respect to the minimum radius of the fly wheel at the bottom of pocket 48 so that when fly wheel 36 is oriented so that the force of fluid is applied to wall 52, then more energy is received from the fluid that would be the case if fly wheel 36 were otherwise oriented. In one embodiment, the depth of pocket 48 may be about 10% to 30% of the radius of fly wheel 36. The depth of pocket 48 also affects the amount of energy recovered from the flow of drilling fluid whereby a deeper pocket tends to absorb a greater amount of energy.

While this embodiment has teeth extending outwardly along the periphery of fly wheel 36 other embodiments may locate fins or teeth on the sides of the wheels positioned within the periphery, with a change in the flow path to engage the teeth or fins. The size and shape of fins will affect the speed of rotation. There could be radial flow paths formed within the fly wheel that are fed from a position interior to the fly wheel. In yet another possible embodiment, fly wheel 37 might have no teeth and operate on friction between the liquid and the fly wheel. Accordingly, the fly wheel may be powered by the drilling fluid in many different ways.

As discussed previously, the fly wheels may be positioned so as to rotate at different angles with respect to each other, thereby providing a gyroscopic effect in different directions. In other words, the fly wheels have an axis of rotation that would extend radially with respect to the tubular housing and each fly wheel axis would be angled differently. The fly wheels may be mounted perpendicular and/or at any desired orientation.

Another advantage of the gyroscopic effect is to reduce wandering or other undesired movement of the bottom hole assembly. The gyroscopic effect may reduce the reverse torsional oscillations of the drill string as well, and be effective to reduce slip stick thereby resulting in drill bits that last longer and/or faster drilling rates and/or a smoother borehole, which allows casing to be run more easily. The type of gyroscopic movement will affect the vibration and may limit the vibration in selected directions, if desired. However, in one preferred embodiment sinusoid vibrations are produced in both axial and radial directions with respect to the axis of tubular housing 20.

Accordingly, fly wheel 36 is mounted or formed on shaft 54, which is then mounted within sockets and/or bearings of chamber 26 gyro harmonic wheel sections 12, 14, and 16. The bearings may be of different types.

FIG. 7 shows a representative housing 56 that may be utilized for mounting fly wheel 36 and/or a timing wheel, as discussed hereinafter. Within the chamber of housing 56, in this embodiment, are sealed frictionless roller bearings 58 (which may also be ball bearings/solid bearings/or other types of bearings) that may be utilized to support fly wheel 36 and/or a timing wheel. It will be noted that a different sized chamber can be used in the timing wheel section 18, which is shown in FIG. 1. The fluid flow path is indicated by arrows 60, 62, and 64. As discussed, hereinbefore, the flow path is designed to maintain a laminar flow leading to fly wheel 36, that reduces turbulent flow, increases energy transfer, and the like as discussed previously. Within the chamber, the wheels tend to push the fluid radially outwardly to act as radial flow turbines.

Figure 8:
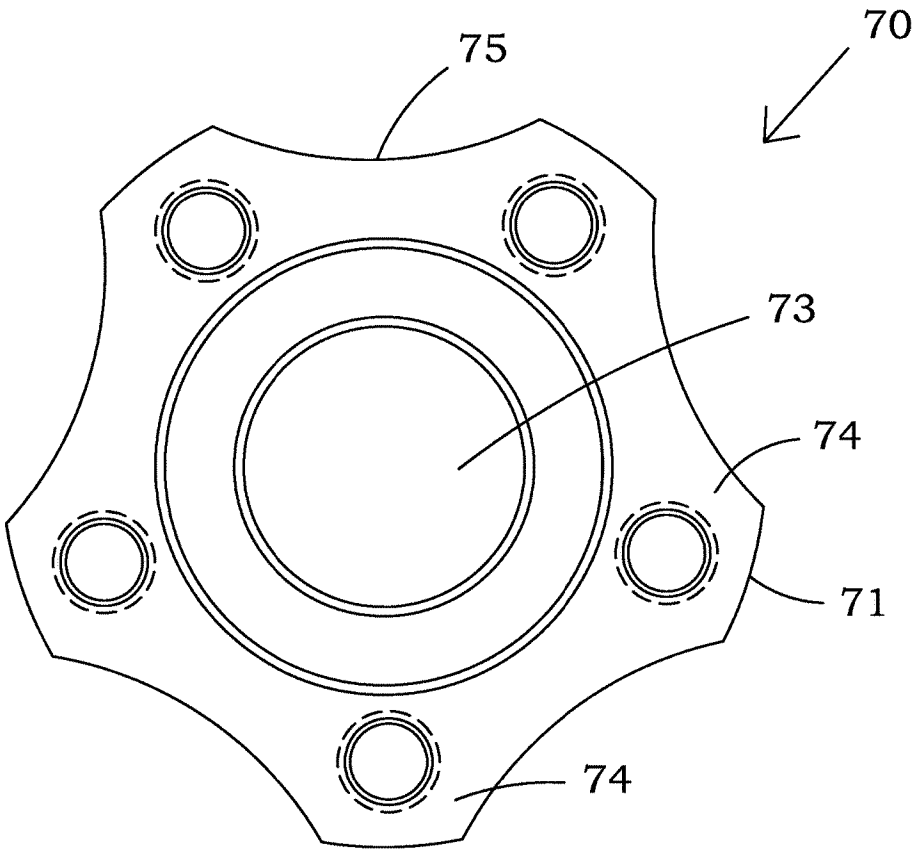
FIG. 8 is a side elevational view of a timing wheel in accord with one possible embodiment of the present invention.
Figure 9:
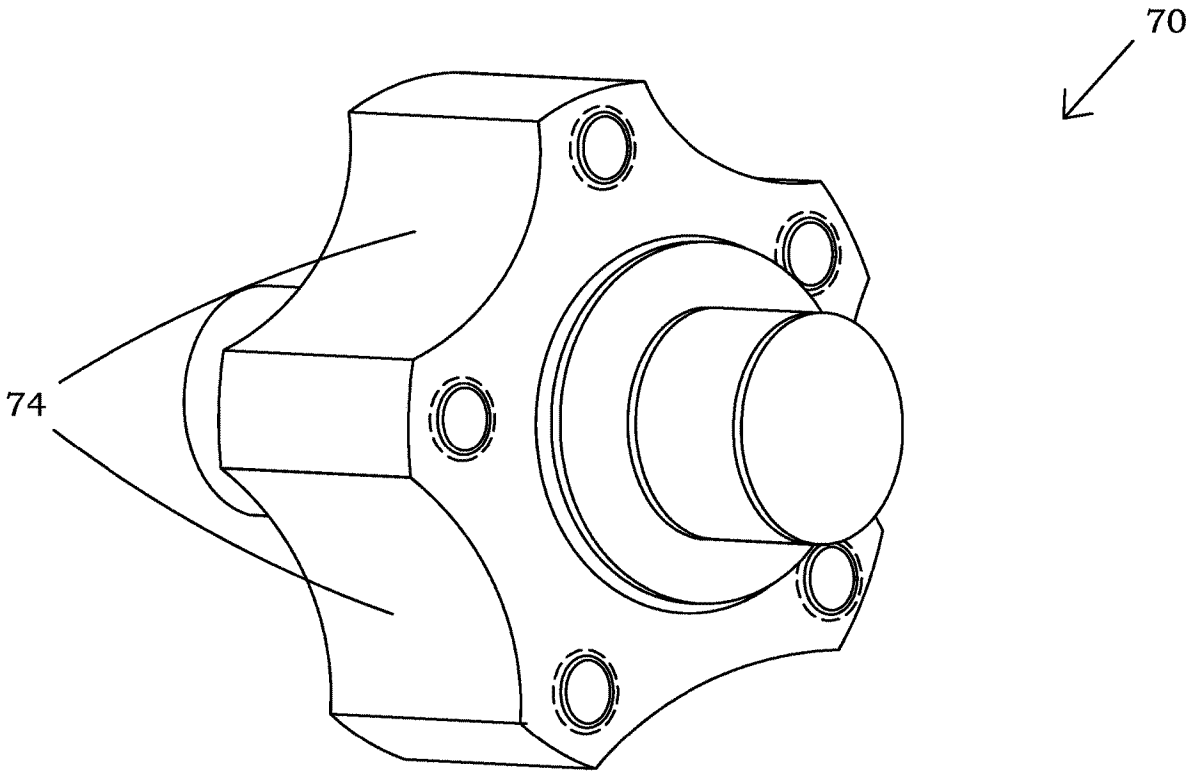
FIG. 9 is a perspective view of the timing wheel of FIG. 8 in accord with one possible embodiment of the present invention.
Figure 10:
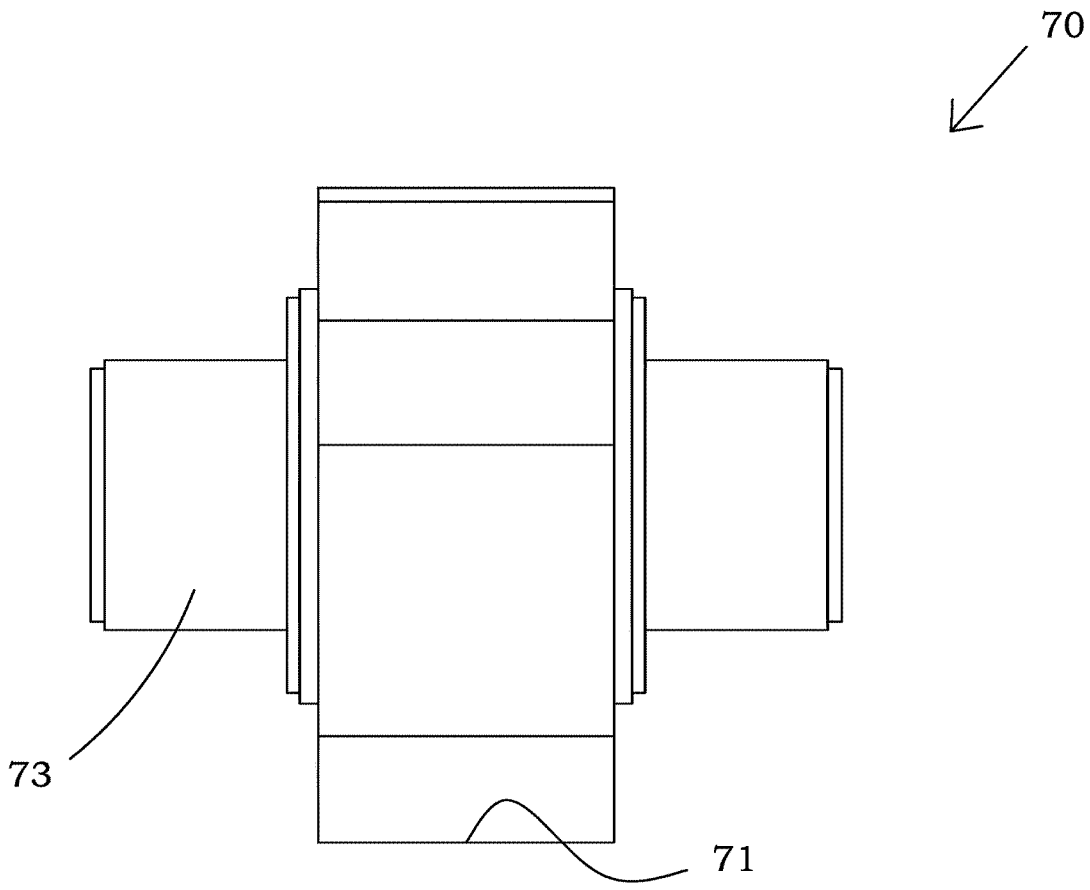
FIG. 10 is a front elevational view of a timing wheel section from FIG. 8 in accord with one possible embodiment of the present invention.

Another embodiment of tool 10 may or may not also utilize one or more timing sections, such as timing section 18, shown in FIG. 1. Timing wheel section 18 comprises timing wheel 70, also shown enlarged in FIGS. 8, 10, and 11. Unlike the fly wheels discussed hereinbefore, timing wheel 70 is preferably centralized within cylindrical chamber 72 (See FIG. 1) and has a maximum radius that is slightly smaller than the radius of cylindrical chamber 72. Accordingly, shaft 73 is centered on timing wheel 70 so that the center of mass of timing wheel 70 preferably coincides with the center of rotation. However, the timing wheel could be offset from the tool centerline and/or have an offset mounting or the like as discussed above with respect to fly wheel 36.

Timing wheel 70 creates pressure or timing pulses within the tubing of coiled tubing due to drilling fluid flow therethrough. In this embodiment, the radius of timing wheel 70 is about 50% to 70% as large as that of the fly wheels but may be larger or smaller as desired. For that matter, as discussed above, the fly wheels may have different sizes and/or offsets, if desired.

In one presently preferred embodiment, the timing wheel does not completely shut off drilling fluid flow. Completely starting and stopping fluid flow may cause problems in the mud motor for rotating the bit and/or other problems. Instead, in a presently preferred embodiment, as discussed previously, the fluid flow pulses but does not shut off completely. If desired, the tolerances of the timing wheel can be increased or decreased to increase or decrease the pulse amplitude (maximum fluid flow rate or maximum drilling fluid pressure) relative to the minimum flow rate or minimum pressure. The tolerances between timing wheel outer circumference 71 and the housing inner circumference may be decreased to increase the minimum flow rates and reduce the pulse amplitudes.

Accordingly, timing wheel 70 restricts or times the fluid flow by some amount and may have resistance to further increase the pulse amplitude. The number of teeth or cogs 74 and/or the width of each cog, may be altered to change the frequency range of the timing section 18.

Timing wheel 70 also effects the fly wheels because the fluid pulses produced by timing wheel 70, the pulse width, and the frequency will limit or control the vibrations created by the fly wheels. During the time that the width of each cog 74 is in the flow path inlet 76, the build up of vibrational speed in the fly wheels is reduced. Accordingly, timing wheel 70 can also be used to further control the period or wavelength of the vibrations and/or the frequency based on the fluid flow allowed.

As well, as discussed hereinbefore, timing wheel 70 may be utilized to smooth the flow of fluid through tool 10 thereby providing better operation of the drilling motor or turbine for rotating bit 110, as discussed hereinbefore.

As discussed previously with respect to the fly wheels, the flow rate of the drilling fluid, which can be varied from the surface, and the number of teeth 74, as well as resistances, weights, the depth of each socket 75, and the like affect the rotational speed and pulse rate of timing wheel 70. Timing 70 may be mounted in a way that resistance to rotation is provided or may be mounted for freely rotating.

Accordingly, in operation, tool 10 is mounted to the bottom hole assembly 108 as shown in FIG. 3. While drilling may be the purpose of introducing tubing into the well, the tool 10 may also be used in downhole assemblies for cleaning scale out of tubulars, work over operations, milling, and/or for other purposes besides drilling through open hole. While preferably mounted in the bottom hole assembly, tool 10 could actually be mounted elsewhere in the drill string if desired. Multiple tools such as tool 10 may be utilized.

During operation, oscillatory harmonic timed tool 10 produces a longitudinal wave action, which is believed to produce an inch worm type of movement that results in an observed downward movement of the drilling string in response to operation of tool 10 either downwardly with the weight of the drilling string or upwardly with upward tension applied to the drill string. This movement may be created with or without use of the timer wheel. This movement may normally be directed downhole due to the weight of the string inching downwardly. Other factors some of which are discussed below has resulted in movement upwardly as upward tension is applied.

In one possible embodiment, the present invention may utilize what is sometimes called the Coanda effect to change direction of our longitudinal movement of our tool. The Coanda effect occurs when jet flow attaches itself to a nearby surface and remains attached even when the surface curves away from the initial jet direction. In some cases, these principles may also involve a Tesla effect involving water surface tension and/or friction.

Figure 14:
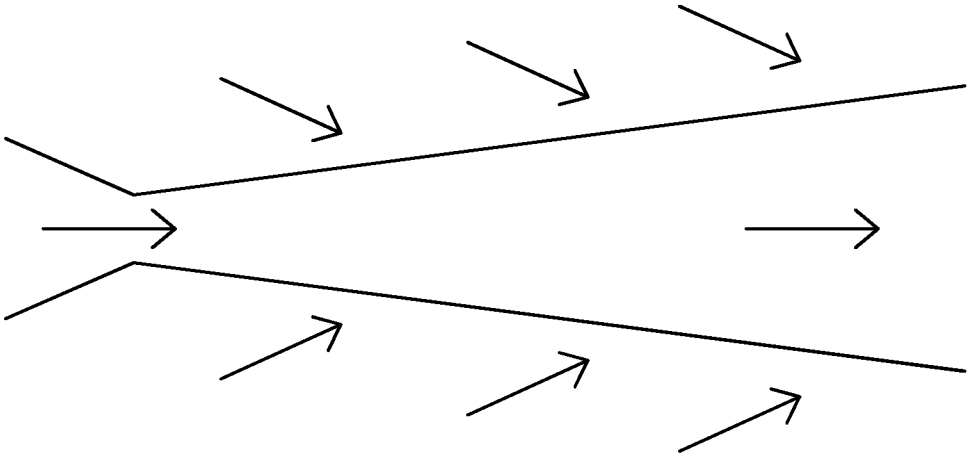
FIG. 14 shows jet flow path in free surroundings.

As shown in FIG. 14, during free jet flow, in free surroundings, a jet of fluid entrains and mixes with its surroundings as it flows away from a nozzle.

Figure 15:
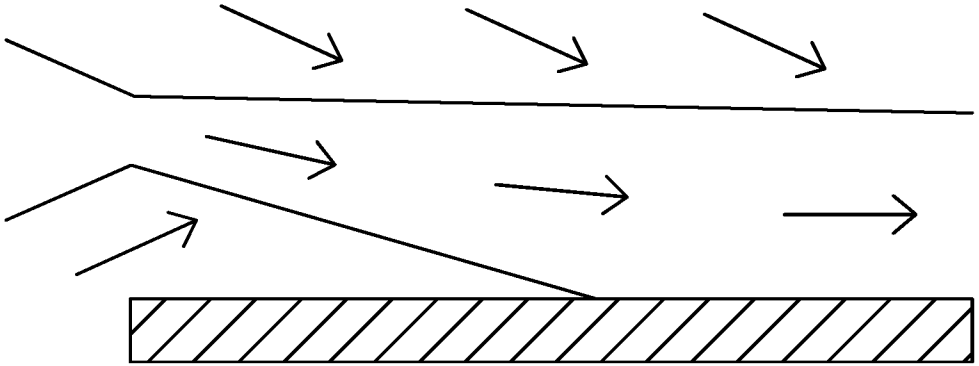
FIG. 15 shows jet flow path attached to an adjacent surface.

In FIG. 15, an example is shown of jet attachment to adjacent surface. In When a surface is brought close to the jet, this restricts the entrainment in that region. As flow accelerates to try to balance the momentum transfer, a pressure difference across the jet results and the jet is deflected closer to the surface—eventually attaching to it.

Figure 16:
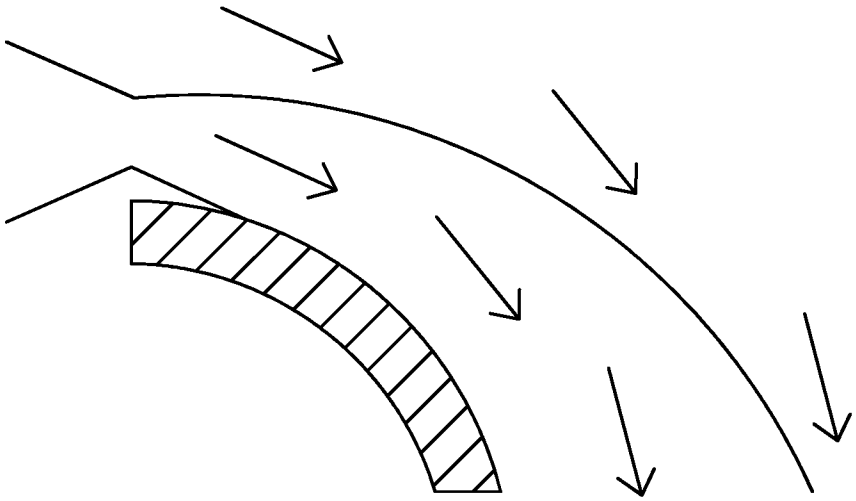
FIG. 16 shows jet flow path attached to a curved surface.

In FIG. 16, the jet attaches to and turns with curved surface even if the surface is curved away from the initial direction, the jet tends to remain attached. This effect can be used to change the jet direction. In doing so, the rate at which the jet mixes is often significantly increased compared with that of a equivalent jet.

The above principles may be used in various embodiments to amplify and reverse the direction and amplitude of the resultant oscillations used in our tool design. There are many variations of the exact Coanda and/or Tesla effects being utilized in our tool. Accordingly, flow and/or weighted Gyro wheels, and/or borehole conditions may be utilized for the purpose of advancing and/or reversing and generally easier movement of the drilling string.

Figure 13:
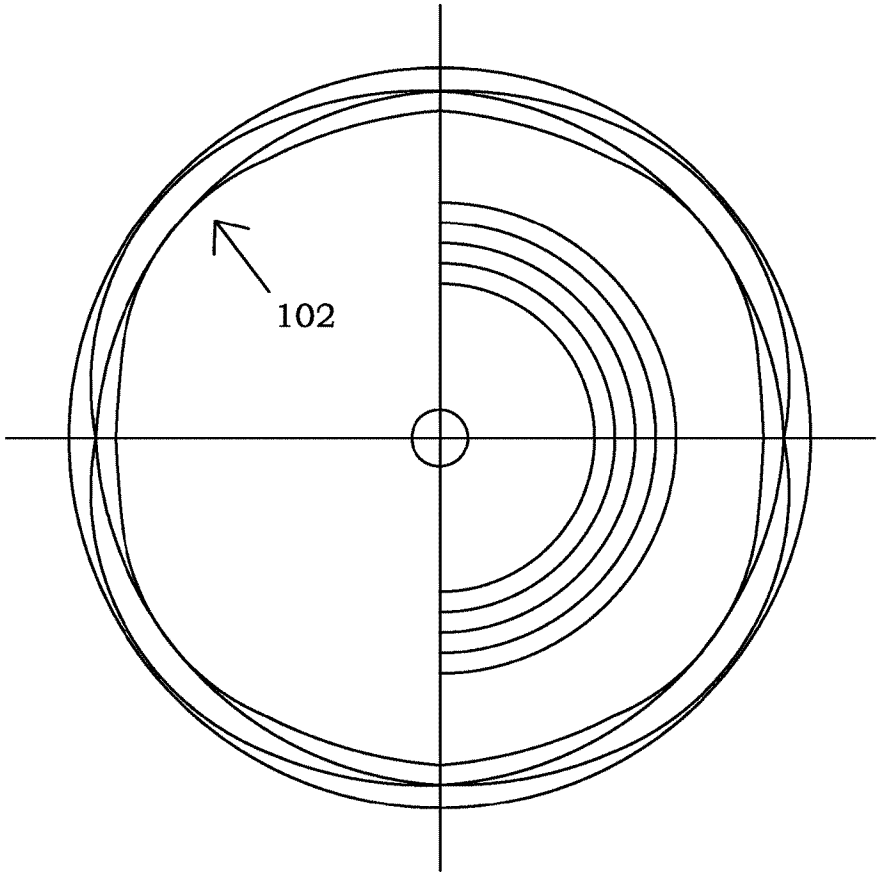
FIG. 13 shows the path of movement of a fly wheel in accord with one possible embodiment of the invention.

FIG. 13 shows the paths of motion 102 of various parts of one embodiment of one or more gyro or fly wheels 36. This motion can produce multiple (e.g., four) vibrations during each revolution. In one embodiment, the desired vibrations may be produced in the range of from 100 HZ to 500 HZ, however other ranges of vibrations may also be produced. The vibrations may be longitudinal waves, oscillation, and/or harmonic motion.

Tool 10 is very short (less than 10 feet in a longer version, less than about 5 feet in the embodiment of FIG. 1 assuming about 4 inch pipe, and in a very short embodiment may be less than one or two feet) and therefore convenient for use in operations which have a lubricator or pressure control tubular 112, as discussed above, at the surface with valves at the bottom to close in the well after the tool is removed from the well bore, whereupon any pressure in the lubricator may be bled off and the tool safely removed from a pressurized well bore.

Assuming tool 10 is utilized in the bottom hole assembly, drilling fluid is pumped into tool 10 as indicated by arrow 22. The fluid is then focused through opening 28 onto fly wheel 36. Opening 28 may have a width or circumference about the same said as the width of fly wheel 36 shown in FIG. 6, and may be oval, elliptical, or the like. Because fly wheel 36 may be mounted with an offset center of mass, as discussed before, vibrations are created. A gyroscopic effect is also created by the spinning fly wheels. The fly wheels may be oriented differently with respect to each other so that the gyroscopic effect is provided in different planes. In other words, rotation in one plane may provide a different gyroscopic effect that rotation in two different planes. The timing wheel 70 will also be rotated, which will affect the amplitude, wavelength, and/or frequency of the vibrations created by the fly wheels. Tool 10 applies a sonic vibration into the drilling motor and bit resulting in a true sonic and/or vibration drill application.

Because the tool is preferably made all metal, including bearings, the temperature rating of the tool is above 500 degrees Fahrenheit. Therefore, the tool may be utilized in geothermal operations, which are normally higher than 350 degrees Fahrenheit.

Various changes may be made within the concepts of the invention. For example, while fly wheel 36 is shown to be substantially circular or have an average circular radius, fly wheel 36 may be asymmetrically shaped, cam shaped, or otherwise shaped as desired. The fins may be utilized to operate other gears, which drive the fly wheel. In another embodiment, a mud motor may be utilized to supply electrical power to operate an electric motor for operation of fly wheel 36 and/or timing wheel 70.

Accordingly, it will be understood that many additional changes in the details, materials, steps and arrangement of parts, which have been herein described and illustrated in order to explain the nature of the invention, may be made by those skilled in the art within the principle and scope of the invention.

The invention claimed is:

1. A propulsion generator for use in a downhole tool to urge movement of a string of pipe within a well bore, said string of pipe comprising a bottom end portion, comprising:

an outer tubular housing mountable to said bottom end portion of said string of pipe, said outer tubular housing including:

a plurality of fly wheel housings, wherein each fly wheel housing defines a fluid flow path through each fly wheel housing to permit a fluid to flow through a downhole tool, wherein the fluid flow path includes at least one of a chamber and a tubular configured to provide a laminar flow to the fluid therethrough;

at least one fly wheel positioned within said each fly wheel housing, said at least one fly wheel comprising a center of mass;

a plurality of fins operatively connected to said at least one fly wheel and positioned within said fluid flow path and configured to receive energy from the fluid flowing through said flow path whereby said at least one fly wheel is rotated, said plurality of fins being rotatable as said at least one fly wheel rotates; and a mounting for said at least one fly wheel which constrains a center of rotation of said at least one fly wheel, whereby said center of mass of said at least one fly wheel is offset from the center of rotation, which results in vibrations being created during rotation of said at least one fly wheel.

2. The propulsion generator of claim 1, wherein said plurality of fins are positioned with respect to said fluid flow path such that during operation as said at least one fly wheel rotates an instantaneous amount of fluid flow through a cross-section of said fluid flow path leading to or leaving from said at least one fly wheel does not vary by more than 30% from an average amount of fluid flow through said cross-section of said fluid flow path.

3. The propulsion generator of claim 1, further comprising a plurality of bearing members for said mounting, said plurality of bearing members being constructed asymmetrically to produce a center of rotation of said at least one fly wheel which is offset from a center of said circumference, whereby said center of mass is offset from the center of rotation.

4. The propulsion generator of claim 1, further comprising a shaft for said at least one fly wheel, said shaft being centrally positioned within said at least one fly wheel, a plurality of bearings comprising an inner bearing and an outer bearing, said outer bearing comprising an outer bearing circular circumference, said inner bearing supporting said shaft such that a center of said shaft is offset from a center of said outer bearing circular circumference.

5. The propulsion generator of claim 1, further comprising a shaft for said at least one fly wheel, said shaft comprising a shaft axis, said shaft axis being positioned at a position offset from a center of an average outer diameter of said at least one fly wheel.

6. The propulsion generator of claim 1, further comprising a timing wheel which is mounted within said outer tubular housing whereby a center of mass of said timing wheel and a center of rotation of said timing wheel are coincident.

7. The propulsion generator of claim 1, wherein said at least one fly wheel is mounted such that said plurality of fins repetitively moves within said fluid path to receive varying energy from said fluid flow whereby a rotational speed of said at least one fly wheel varies during operation.

8. A method for making a propulsion generator to urge movement of a string of pipe within a well bore, said string of pipe comprising a bottom end portion, said method comprising:

providing an outer tubular housing for said downhole tool that includes a plurality of fly wheel housings, wherein each fly wheel housing defines a fluid flow path that includes at least one of a chamber and a tubular through each fly wheel housing configured to permit a laminar flow of a fluid there through;

providing at least one fly wheel within each fly wheel housing, said at least one fly wheel comprising a center of mass;

providing that said at least one fly wheel receives energy for rotation in response to the fluid flowing through said fluid flow path; and providing a mounting for said at least one fly wheel that controls a center of rotation of said at least one fly wheel, whereby said center of mass of said at least one fly wheel is offset from said center of rotation, which results in vibrations being created during rotation of said at least one fly wheel.

9. The method of claim 8, further comprising providing bearings to produce a center of rotation of said at least one fly wheel which is offset from a center of an average circumference of said at least one fly wheel.

10. The method of claim 8, further comprising utilizing a shaft for said at least one fly wheel, and utilizing an inner bearing and an outer bearing wherein said outer bearing comprises an outer bearing circular circumference and said inner bearing supports said shaft such that a center of said shaft is offset from a center of said outer bearing circular circumference.

11. The method of claim 8, further utilizing a shaft for said at least one fly wheel, said shaft comprising a shaft axis which is positioned at a position offset from a center of said at least one fly wheel with respect to an average outer circumference of said at least one fly wheel.

12. The method of claim 8, further comprising utilizing a second wheel comprising a plurality of fins which are positioned to engage fluid flow through said fluid flow path, and providing that a center of mass of said second wheel coincides with a center of rotation of said second wheel.

13. The method of claim 8, further comprising said propulsion generator is constructed so that a variation of an amount of instantaneous fluid flow through a cross-section of a fluid flow path leading to or leaving from said at least one fly wheel does not vary by more than 30% than an average amount of fluid flow through said cross-section of said fluid flow path.

* * * * *